US009803343B2

(12) United States Patent
Montoya

(10) Patent No.: US 9,803,343 B2
(45) Date of Patent: Oct. 31, 2017

(54) FAUCET ATTACHMENT ADAPTER

(71) Applicant: Alexander Montoya, Westminster, CO (US)

(72) Inventor: Alexander Montoya, Westminster, CO (US)

(73) Assignee: Alexander Montoya, Westminster, CO (US)

( * ) Notice: Subject to any disclaimer, the term of this patent is extended or adjusted under 35 U.S.C. 154(b) by 328 days.

(21) Appl. No.: 13/888,472

(22) Filed: May 7, 2013

(65) Prior Publication Data

US 2014/0333059 A1 Nov. 13, 2014

(51) Int. Cl.
*E03C 1/086* (2006.01)
*E03C 1/04* (2006.01)

(52) U.S. Cl.
CPC ..... *E03C 1/0404* (2013.01); *E03C 1/086* (2013.01)

(58) Field of Classification Search
CPC ..... F16L 37/48; F16L 21/005; F16L 21/035; F16L 33/207; F16L 33/2071; F16L 33/2075; F16L 37/05; E03C 1/086
USPC ..... 285/8, 12, 109, 314
See application file for complete search history.

(56) References Cited

U.S. PATENT DOCUMENTS

| | | | | | |
|---|---|---|---|---|---|
| 1,000,414 | A * | 8/1911 | Kintner | 285/8 | |
| 2,326,479 | A * | 4/1943 | Mejdrich | F16L 37/00 285/8 | |
| 2,688,499 | A * | 9/1954 | Hanson | 285/8 | |
| 2,711,331 | A * | 6/1955 | Temple | 285/8 | |
| 3,271,053 | A * | 9/1966 | Kurachi | 285/8 | |
| 3,638,968 | A * | 2/1972 | Barks | 285/8 | |
| 3,986,737 | A * | 10/1976 | Krusche | 285/7 | |
| 4,045,058 | A * | 8/1977 | Eross | 285/272 | |
| 4,223,919 | A * | 9/1980 | Kurachi | 285/8 | |
| 4,231,400 | A * | 11/1980 | Friedling et al. | 285/8 | |
| 4,266,813 | A * | 5/1981 | Oliver | 285/12 | |
| 4,779,904 | A * | 10/1988 | Rich | 285/8 | |
| 5,087,081 | A * | 2/1992 | Yoon | 285/8 | |
| 5,330,234 | A * | 7/1994 | Sweeny | 285/62 | |
| 6,431,217 | B2 * | 8/2002 | Robinson | 138/110 | |

* cited by examiner

*Primary Examiner* — David E Bochna

(57) ABSTRACT

Methods and apparatus are provided through which in one preferred embodiment a faucet attachment adapter includes a seal, a seal housing, an adapter housing and a hose adapter. A first end of the seal is mounted to an interior of the seal housing. A second end of the seal is mounted to an interior of the adapter housing. The adapter housing is free to rotate relative to the seal housing. An end of the seal housing may be placed over a faucet or spigot. Rotation of the second end of the seal relative to the first end of the seal allows the seal to rotate between an open orientation and a sealing orientation around the faucet or spigot. An end of a hose is connectable to the hose adapter. A spray or scrubber attachment may then be connected to the other end of the hose. A locking mechanism may be utilized to prevent unwanted rotation of the adapter housing relative to the seal housing.

17 Claims, 14 Drawing Sheets

FAUCET ATTACHMENT ADAPTER

RELATED APPLICATIONS

There are no related applications for this application.

FIELD

The field of the invention relates generally to devices connecting to a faucet or spigot on one end and to a hose on another end.

BRIEF DESCRIPTION

A faucet attachment adapter is disclosed. The faucet attachment adapter comprises a seal, wherein the seal has a first end and a second end, a seal housing, an adapter housing, a hose adapter, wherein the adapter housing is adapted to rotate relative to the seal housing.

The first end of the seal is fixedly mounted to an interior of the seal housing.

The second end of the seal is fixedly mounted to an interior of the adapter housing.

In use, the adapter housing is rotated such that the attached second end of the seal rotates relative to the first end of the seal attached to the seal housing such that the seal is adapted to be oriented in a sealing and an open orientation.

One end of a hose is attachable to the hose adapter and the other end of the hose is attachable to a cleaning attachment such as a sprayer or a scrubber.

DETAILED DESCRIPTION

Figure 1:
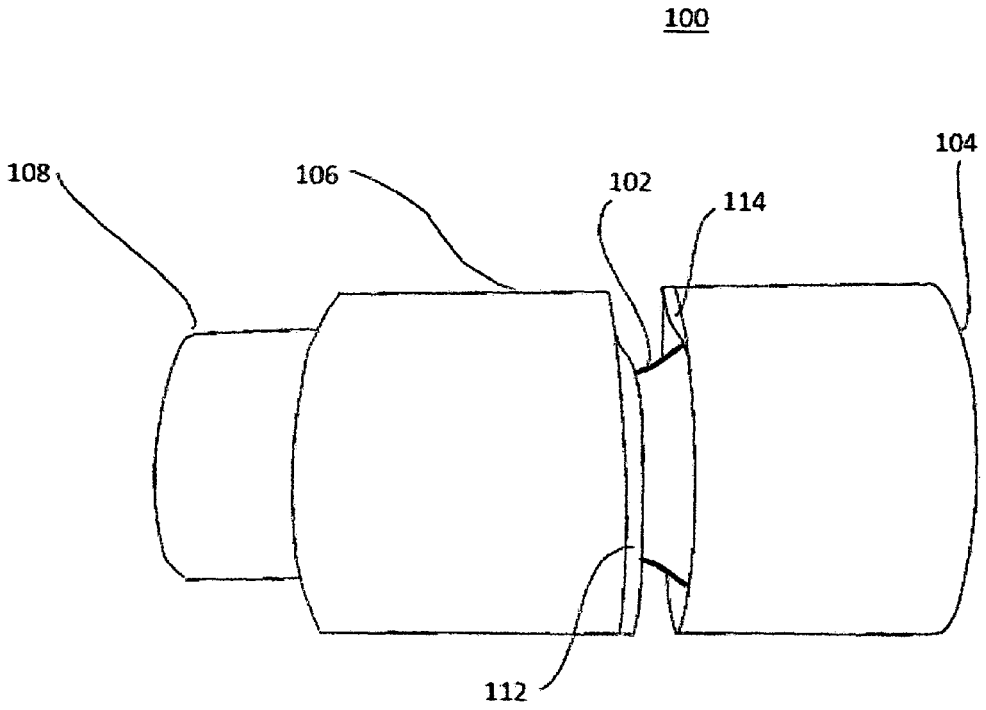
FIG. 1 is a perspective view of the faucet attachment adapter illustrating a first end of the seal secured to an inside surface of the seal housing and a second end of the seal secured to an inside surface of the adapter housing of the adapter housing that is free to rotate relative to the seal housing according to an implementation.

FIG. 1 is a perspective view of the faucet attachment adapter 100 illustrating a first end of the seal 102 secured to an inside surface of the seal housing 104 and a second end of the seal secured to an inside surface of the adapter housing 106 that is free to rotate relative to the seal housing 104.

Figure 2:
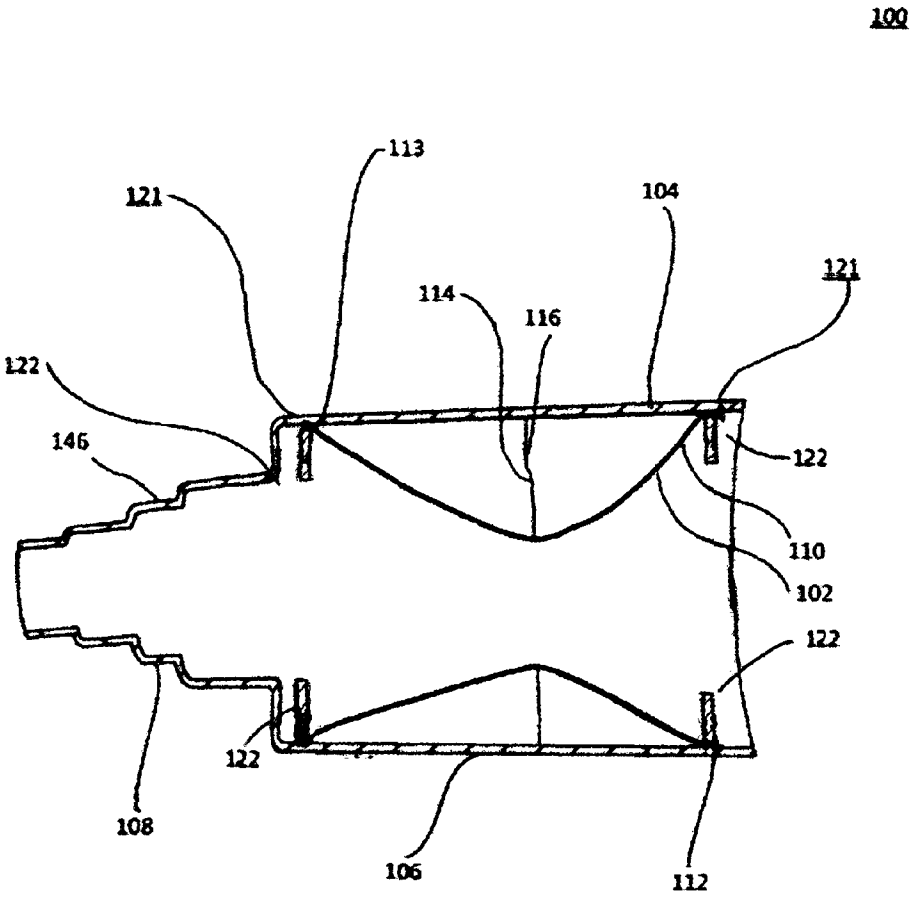
FIG. 2 is a cross-sectional view of one preferred embodiment of the faucet attachment adapter, according to an implementation.
Figure 5:
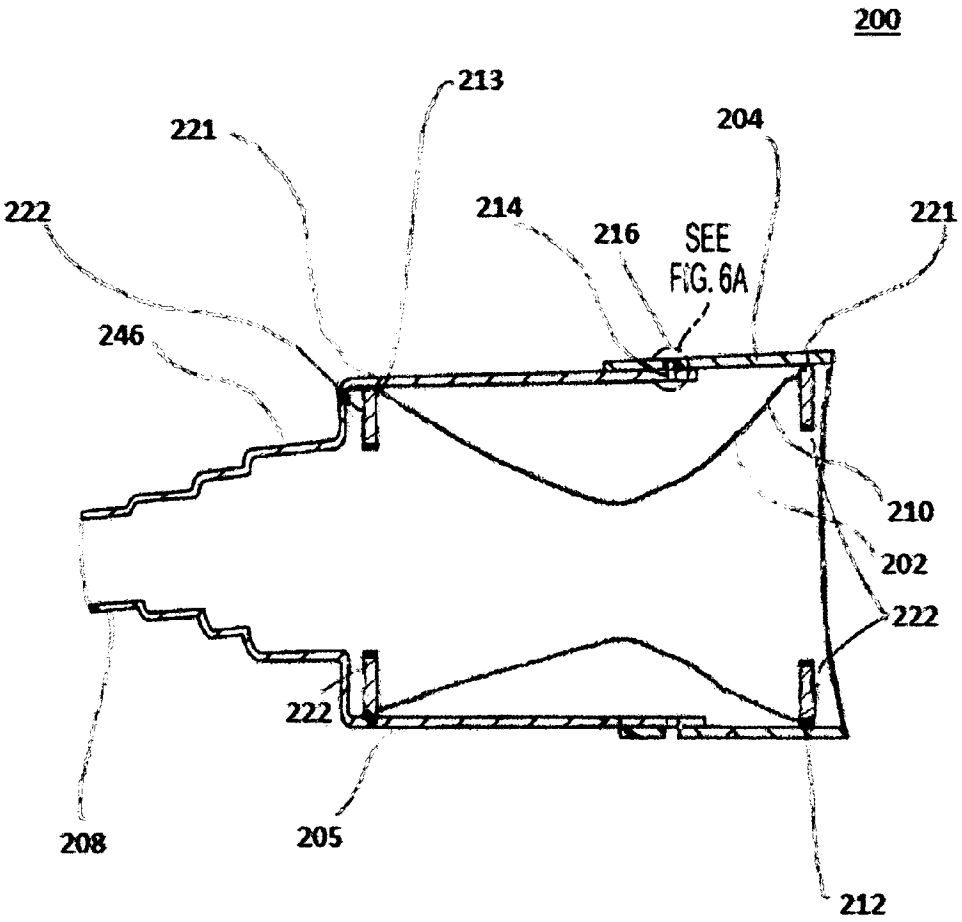
FIG. 5 is a cross-sectional view of another embodiment of the faucet attachment adapter, according to an implementation.

FIG. 2 is a cross-sectional view of one preferred embodiment of the faucet attachment adapter 100. In one preferred embodiment, as illustrated on FIG. 2, the seal 102 is configured as an iris seal 110. A first end 112 of the iris seal 110 is retained and sealed to a circumferential groove. 121 on an inner surface of the seal housing 104 as illustrated on FIG. 2. A snap ring 122 is installed in the circumferential groove 121 to captivate and provide sealing of the second end 113 of the iris seal 110 between the circumferential groove 121 and the snap ring 122. Similarly, a second end 113 of the iris seal 110 is retained and sealed to a circumferential groove 121 on an inner surface of the adapter housing 106 by snap ring 122, as illustrated on FIG. 2. The hose adapter 108 allows different size hoses to be connected to the faucet attachment adapter 100. FIG. 2 in addition to FIG. 5 illustrates the hose adapter 108 configured as tapered steps 146. However, the configuration of the hose adapter 108 is not limited to a tapered step 146 configuration. Other hose adapter 108 configurations may be a spigot 138 as illustrated on FIGS. 3 and 8, or a serrated cone 139 as illustrated on FIG. 7. In addition to a serrated cone 139 as illustrated on FIG. 7, the hose adapter 108 may also be configured as a barbed cone. Other types of hose adapters 108 may include designs such as use of a flexible bladder 400 to slip-over a hose as illustrated on FIGS. 13 and 14 without departing from the scope of this invention. Additionally, as illustrated on FIG. 2, the forward face of the adapter housing 106 is configured as a cam 114, with a sloped surface. The rear face of the seal housing 104, which mates with the forward face of the adapter housing 106 is configured as a follower 116. Further, the adapter housing 106 is capable of rotating relative to the seal housing 104.

Figure 3:
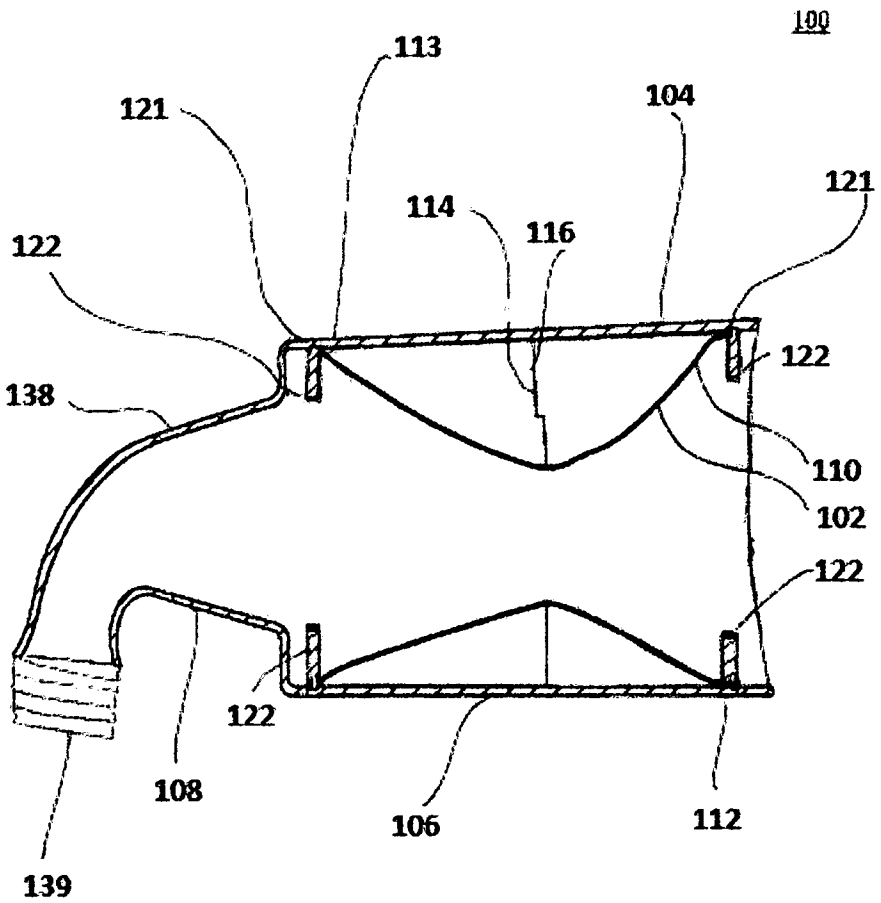
FIG. 3 is a cross-sectional view of one preferred embodiment of the faucet attachment adapter, according to an another implementation.
Figure 4:
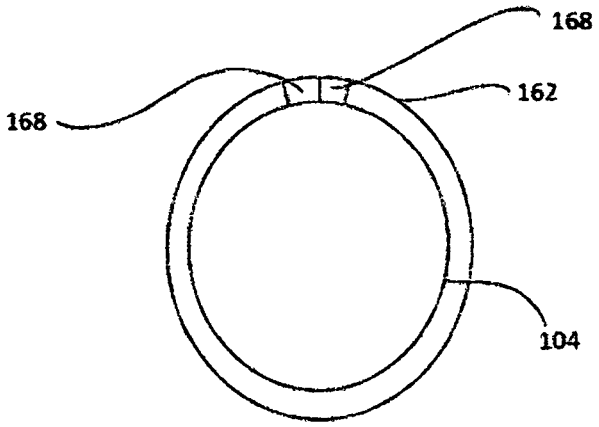
FIG. 4 is an end view of the locking mechanism viewed from the end of the seal housing, according to an implementation.

FIG. 3 is a cross-sectional view of one preferred embodiment of the faucet attachment adapter 100. As in FIG. 2, the seal 102 is configured as an iris seal 110. As in FIG. 2, the first end 112 of the iris seal 110 is retained and sealed to a circumferential groove 121 on an inner surface of the seal housing 104 by snap ring 122. Similarly, a second end 113 of the iris seal 110 is retained and sealed to a circumferential groove 121 on an inner surface of the adapter housing 106 by snap ring 122. In FIG. 3, the hose adapter 108 is configured as a spigot 138 with a threaded connection 139 on the end of the spigot 138.

The locking mechanism 162 consists of a seal housing side 164 and an adapter housing side 166. Each of the seal housing side 164 and adapter housing side 166 of the locking mechanism 162 is formed with a single tooth 168. The tooth 168 on the seal housing side 164 is engagable with a tooth 168 on the adapter housing side 166. The tooth 168 on the seal side 164 is disengaged from the tooth 168 on the adapter side 166 by manually pulling the seal housing 104 apart from the adapter housing 106.

In use of the preferred embodiment of FIGS. 1-4, a user places the faucet attachment adapter 100 over a faucet. A user manually rotates the adapter housing 106 relative to the seal housing 104. This rotation causes the iris seal 110 to move from an open position 142, as illustrated on FIG. 10 which allows the faucet attachment adapter 100 to be placed over a faucet, to a sealing position 144 as illustrated on FIG. 11 in which the iris seal seals around the faucet. Manual rotating of the adapter housing 106 relative to the seal housing 104 also causes the adapter housing 106 to separate axially from the seal housing 104. This axial separation of the adapter housing 106 from the seal housing 104 is caused by the follower 116 following the cam 114 during the manual rotating. This axial separation of the adapter housing 104 from the seal housing 106 stretches the iris seal 110. As the stretched iris seal 110 is attached at a first end 112 to the seal housing 104 and at a second end 113 to the adapter housing 106, frictional forces from the stretched iris seal are imparted where the cam 114 and follower 116 contact. These frictional forces act to make it difficult for relative movement between the cam 114 and follower 116 to occur. Relative movement between the cam 114, which is on a forward face of the adapter housing 106 and the follower 116 which is on an aft face of the seal housing 104 is unwanted, as this relative movement would cause the iris seal 110 to untwist and no longer be in the sealing position 144. The use of the preferred embodiment of FIGS. 1 and 3 is generally the same as FIGS. 1 and 2. The only difference is that the cam 114 and follower 116 profiles in FIG. 3 are stepped, instead of being sloped in FIG. 2. The stepped cam 114 and follower 116 profiles in FIG. 3 require that the adapter housing 106 and seal housing 104 first be manually separated before the adapter housing 106 is rotated relative to the seal housing 104. For extra assurance against unwanted rotation of the adapter housing 106 relative to the seal housing when the iris seal 110 is sealed around a faucet, a locking mechanism 162, as illustrated on FIGS. 4A-4C may be optionally utilized. In use of the locking mechanism 162, the adapter housing 106 is manually separated from the seal housing 104. This separation causes the teeth 168 in the locking mechanism 162 to move from being engaged as illustrated in FIG. 4A to being disengaged as illustrated in FIG. 4B. On the teeth 168 are disengaged, the adapter housing 106 may be rotated relative to the seal housing 104 to seal the iris seal 110 around a faucet. Once the iris seal 110 is sealed around the faucet, the teeth 168 of the locking mechanism 162 are again engaged so that the adapter housing 106 may not rotate relative to the seal housing 104 so that the iris seal 110 remains sealed around the faucet. FIG. 4C illustrates that the locking mechanism 162 is located at an outer circumference of the seal housing 104 and adapter housing 106.

FIG. 5 is a cross-sectional view of one preferred embodiment of the faucet attachment adapter 200. In one preferred embodiment, as illustrated on FIG. 5, the seal 202 is configured as an iris seal 210. A first end 212 of the iris seal 210 is retained and sealed to a circumferential groove 221 on an inner surface of the seal housing 204 as illustrated on FIG. 5. A snap ring 222 is installed in the circumferential groove 221 to captivate and provide sealing of the second end 213 of the iris seal 210 between the circumferential groove 221 and the snap ring 222. Similarly, a second end 213 of the iris seal 210 is retained and sealed to a circumferential groove 221 on an inner surface of the adapter housing 206 by snap ring 222, as illustrated on FIG. 5. The hose adapter 208 allows different size hoses to be connected to the faucet attachment adapter 200. FIG. 5 in addition to FIGS. 2 and 7 illustrate the hose adapter 208 configured as tapered steps 246. However, the configuration of the hose adapter 208 is not limited to a tapered step 246 configuration. Additionally, as illustrated on FIG. 5, the adapter housing 206 has a socket fit within the seal housing 204. A pin 214 is located on an outer circumferential surface of the socket fit portion of the adapter housing 206. A channel 216 is located on an inner circumferential surface of the socket fit portion of the seal housing 204. Also, a portion of the seal 202 is cutaway on FIG. 5 in order to facilitate illustration of a rise channel portion 219 and pocking portion 220 of the channel 216. The curved section lines in FIG. 5 illustrate that FIG. 6B is a surface view of the inner diameter of the seal housing 204 in the vicinity of the seal housing 204.

Figure 6A:
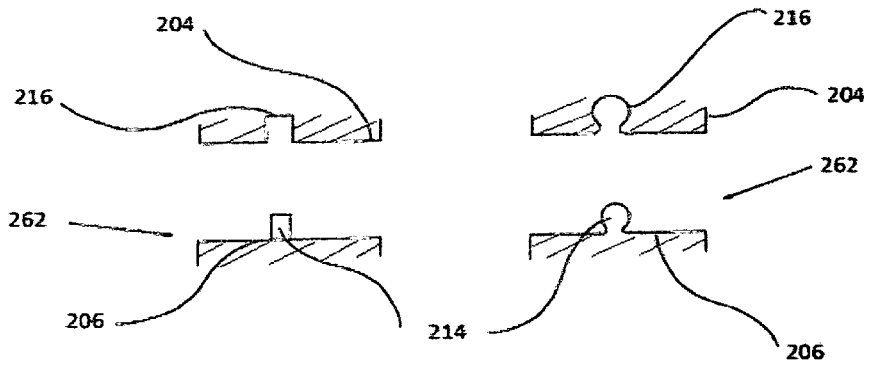
FIG. 6A is detail view of another embodiment of a locking mechanism, according to an implementation.

FIG. 6A is detail view of another embodiment of a locking mechanism 262. The locking mechanism 262 includes a "pin" 214 which rides within a "channel" 216. FIG. 6A illustrates two embodiments of the pin 214 and channel 216. In one embodiment illustrated in FIG. 6A, the pin 214 is cylindrical-shaped and the channel 216 is square or rectangular-shaped when viewed in cross-section. In another embodiment illustrated in FIG. 6A, the pin 214 is spherical-shaped and the channel 216 is also spherical-shaped when viewed in cross-section. The pin 214 and channel 216 are not limited to the shapes illustrated on FIG. 6A, although the pin 214 should be symmetric and have no discontinuities on an outer surface of the pin 214 in order for the pin 214 to follow the three-dimensional path of the channel 216. FIG. 6B is surface view of the groove of a locking mechanism along the circumference of an inner diameter of the seal housing 204. Note that although FIG. 6B is illustrated as flat, that the inner diameter of the seal housing 204 and channel 216 illustrated on FIG. 6B is actually a circumferential surface in an inner diameter of the seal housing 204. As illustrated on FIG. 5 and FIG. 6B, the channel 216 includes an insertion portion 217, a dwell channel portion 218, a rise channel portion 219 and a locking portion 220. The pin 214 is illustrated on FIG. 6B located in the dwell channel portion 218 of the channel 216. The channel 216 illustrated on FIGS. 5 and 6B is illustrated as approximately 270 degrees long starting at about a 12 o'clock position and ending at about a 9 o'clock position when viewing the seal housing 204 in a section view. However, the channel illustrated on FIGS. 5 and 6B is not limited to the above lengths, or orientations.

Figure 6B:
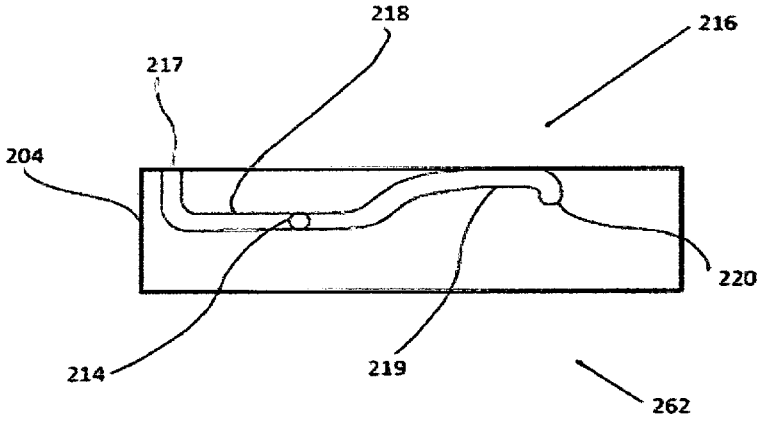
FIG. 6B is surface view of the groove of a locking mechanism along a circumference of an inner diameter of the seal housing, according to an implementation.

In assembly of the embodiment of FIGS. 5-6B at a manufacturing site, the adapter housing 206 is socket fit inside the seal housing 204. Also, during assembly, the pin 214 is inserted into the insertion portion 217 channel and the adapter housing 206 and is then rotated relative to the seal housing 204 such that the pin 214 is located within the dwell portion 218 (FIG. 6B) of the channel 216. In use of the embodiment of FIGS. 5-6B, a user rotates the adapter housing 206 relative to the seal housing so that the pin 214 is moved from the dwell channel portion 218 so that the pin is then located proximal the rise channel portion 219. When the seal 202 is to be moved from an open configuration 242 (FIG. 10) to a sealing configuration 244 (FIG. 11), the adapter housing 206 is rotated relative to the seal housing 204. This causes the seal 202 to be placed in a closed configuration (FIG. 11). During this rotation, the pin 214 is caused to move into the rise channel portion 219 and then into the locking portion 220 of the channel 216. Once the pin 214 is located in the locking position 220 (FIG. 6B), the seal 202 is then constrained to remain in the closed configuration (FIG. 11) and may not move inadvertently into the open configuration (FIG. 10) due to the pin 214 located in locking portion 220, which is located 90 degrees from the rise channel portion 210 of the channel 216 (FIG. 6B).

FIG. 7 is a cross-sectional view of one embodiment of the faucet attachment adapter 300. In one preferred embodiment, as illustrated on FIG. 7, the seal 302 is configured as an iris seal 310. A first end 312 of the iris seal 310 extends to an outer surface of the seal housing 304. A circumferential collar 311 retains and seals the first end 312 of the iris seal 310 to the seal housing 304. To facilitate retention of the first end 312 of the iris seal 310 to the seal housing 304, an inner surface of the circumferential collar 311 and an outer surface of the seal housing 304 in contact with the circumferential collar 311 may be threaded or contain serrations. However, the seal may be retained via any suitable means. A second end 313 of the iris seal 310 is retained and sealed to a mating surface between the center section of the adapter that is free to rotate 306 and the hose adapter 308 as illustrated on FIGS. 5 and 5A. The seal housing 304 has external threads 318 at one end of the seal housing 304. The external threads 318 at one end of the seal housing 304 mate with internal threads 319 at one end of the center section of the adapter that is free to rotate 306. The mating threads 318 and 319 allow the center section of the adapter that is free to rotate 306 to rotate relative to the seal housing 304. The hose adapter 308 allows different size hoses to be connected to the faucet attachment adapter 300. FIG. 7 illustrates the hose adapter 308 configured as steps 346. However, the configuration of the hose adapter 308 is not limited to a step 346 configuration. Other hose adapter 308 configurations may be a threaded spigot 238 as illustrated on FIG. 3 or 8, or a serrated cone 339 as illustrated on FIG. 9. In addition to a serrated cone 339 as illustrated on FIG. 9, the hose adapter 308 may also be configured as a barbed cone. Other types of hose adapters 308 may include designs such as use of a flexible bladder 402 to slip-over a hose as illustrated on FIGS. 13 and 14 without departing from the scope of this invention.

Figure 7A:
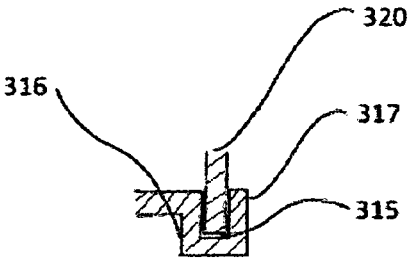
FIG. 7A is a detail view of mating surfaces of the center section of the adapter that is free to rotate and the hose adapter of the faucet attachment adapter without the seal installed of FIG. 7, according to an implementation.
Figure 7:
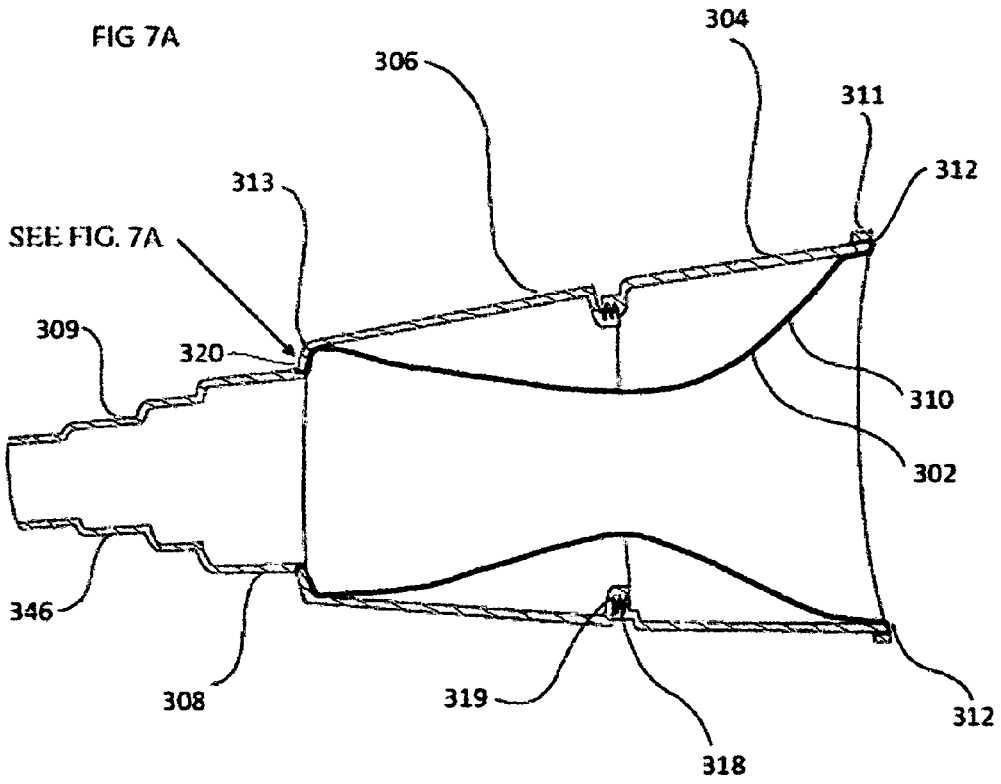
FIG. 7 is a cross-sectional view of another embodiment of the faucet attachment adapter, according to another implementation.

FIG. 7A is a detail view of the mating surfaces of the center section of the adapter that is free to rotate 306 and the hose adapter 308 of the faucet attachment adapter 300 without the seal 302 installed. As illustrated on FIGS. 7 and 7A, an end of the center section of the adapter that is free to rotate 306 has an inward oriented end 320. The inward oriented end 320 engages with a circumferential depression 315 formed on a lower part of a first circumferential lip 316 on an end of the hose adapter 308. As illustrated on FIG. 7, the second end 313 of the iris seal 310 is captivated between and provides a seal between the inward oriented end 320 of the center section of the adapter that is free to rotate 306 and the circumferential depression 315 formed on the lower part of the first circumferential lip 316 on an end of the hose adapter 308. A second circumferential lip 317 on the end of the hose adapter 308 facilitates retention of the hose adapter 308 to the center section of the adapter that is free to rotate 306. In order to prevent unwanted rotation of the seal housing 304 to the center section 306 when the seal 302 is in the sealing orientation (FIG. 11), the locking mechanism 182 of FIG. 4 may be utilized in the embodiment of FIG. 7.

Figure 8:
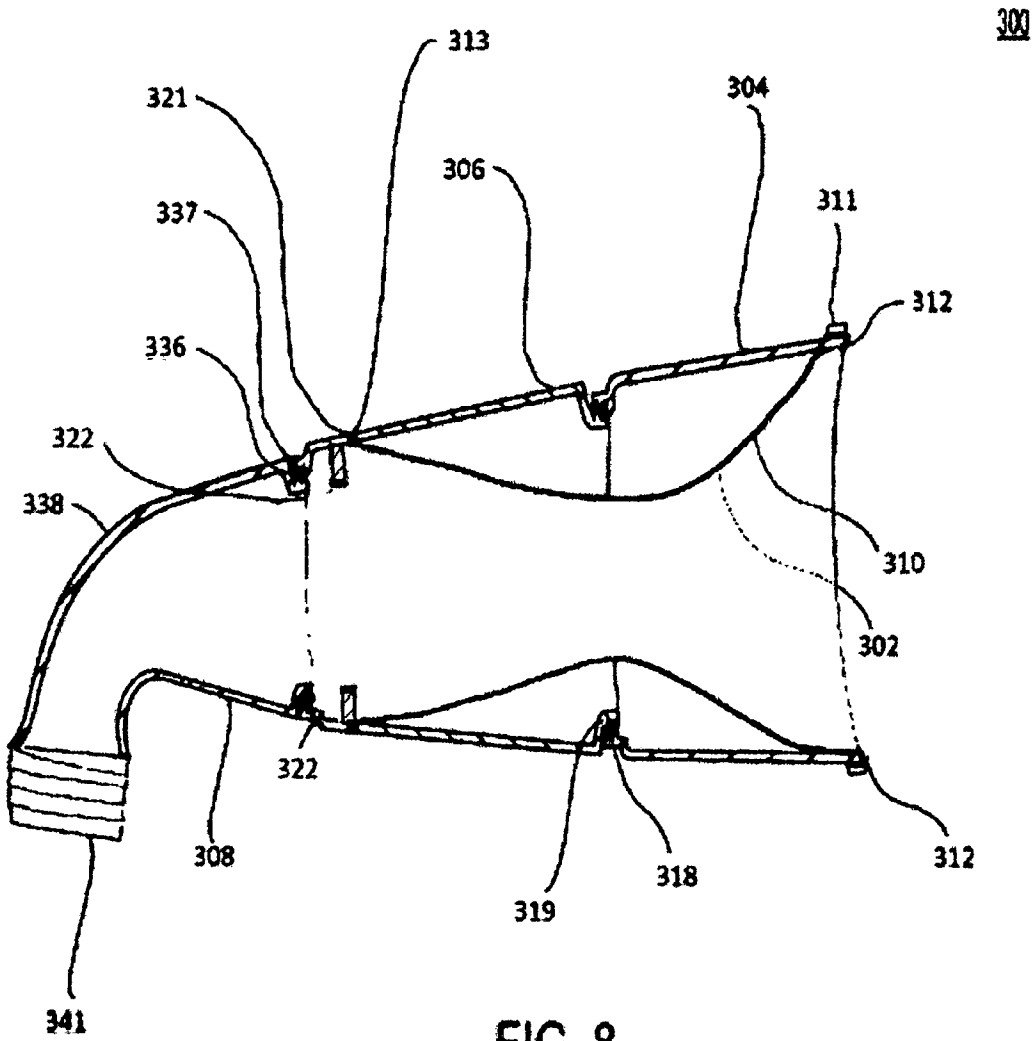
FIG. 8 is a cross-sectional view of one embodiment of the faucet attachment adapter, according to an another implementation.

FIG. 8 is a cross-sectional view of one embodiment of the faucet attachment adapter 300, according to another implementation. En one preferred embodiment, as illustrated on FIG. 7, the seal 302 is configured as an iris seal 310. A first end 312 of the iris seal 310 extends to an outer surface of the seal housing 304. As in the implementation of FIG. 7, the circumferential collar 311 retains and seals the first end 312 of the iris seal 310 to the seal housing 304. To facilitate retention of the first end 312 of the iris seal 310 to the seal housing 304, an inner surface of the circumferential collar 311 and an outer surface of the seal housing 304 in contact with the circumferential collar 311 may be threaded, contain serrations, or use other retention means. A second end 313 of the iris seal 310 is retained and sealed to a circumferential groove 321 on an inner surface of the center section of the adapter that is free to rotate 306 as illustrated on FIG. 8. A snap ring 322 is installed in the circumferential groove 321 to captivate and provide sealing of the second end 313 of the iris seal 310 between the circumferential groove 321 and the snap ring 322. The seal housing 304 has external threads 318 at one end of the seal housing 304. The external threads 318 at one end of the seal housing 304 mate with internal threads 319 at one end of the center section of the adapter that is free to rotate 306. The mating threads 318 and 319 allow the center section of the adapter that is free to rotate 306 to rotate relative to the seal housing 304. The hose adapter 308 has internal threads 336 at one end. The internal threads 336 at one end of the hose adapter 308 mate with external threads 337 at another end of the center section of the adapter that is free to rotate 306. The mating threads 336 and 337 allow the center section of the adapter that is free to rotate 306 to rotate relative to the hose adapter 308. The hose adapter 308 allows different size hoses to be connected to the faucet attachment adapter 300. FIG. 8 illustrates the hose adapter 308 configured as a spigot 338 with a threaded connection 341. The threaded connection 341 on the spigot 338 allows a threaded hose to be attached to the spigot 338. In order to prevent unwanted rotation of the seal housing 304 to the center section 306 when the seal 302 is in the sealing orientation (FIG. 11), the locking mechanism 182 of FIG. 4 may be utilized in the embodiment of FIG. 8.

Figure 9:
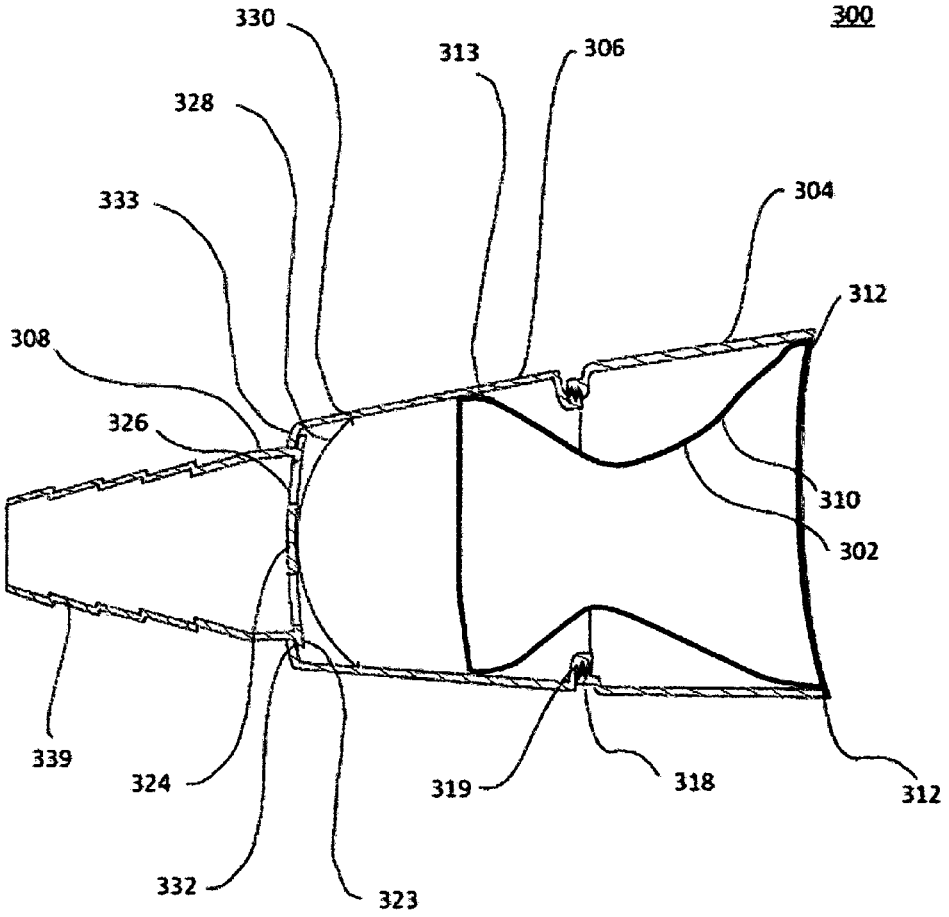
FIG. 9 is a cross-sectional view of one preferred embodiment of the faucet attachment adapter, according to an another implementation.

FIG. 9 is a cross-sectional view of one embodiment of the faucet attachment adapter 300 according to yet another implementation. In one embodiment, as illustrated on FIG. 9, the seal 302 is configured as an iris seal 310. A first end 312 of the iris seal 310 is sealed to the seal housing 304. A second end 313 of the iris seal 310 is sealed to an inside surface of the center section of the adapter that is free to rotate 306. The iris seal 310 may be sealed to the seal housing 304 and the center section of the adapter that is free to rotate 306 by vulcanizing, mechanical means, or by any other suitable attachment means. The seal housing 304 has external threads 318 at one end of the seal housing 304. The external threads 318 at one end of the seal housing 304 mate with internal threads 319 at one end of the center section of the adapter that is free to rotate 306. The mating threads 318 and 319 allow the center section of the adapter that is free to rotate 306 to rotate relative to the seal housing 304. The other end of the center section of the adapter that is free to rotate 306 has an inwardly curved end 333. The inwardly curved end 333 of the center section of the adapter that is free to rotate 306 mates with a circumferential end cap with openings 323 on the other end of the hose adapter 308. The circumferential end cap with openings 323 includes a solid center 324 and a plurality of circumferential openings 326. The inwardly curved end 333 of the center section of the adapter that is free to rotate 306 and the circumferential end cap with openings 323 on the hose adapter 308 allows the center section of the adapter that is free to rotate 306 to rotate relative to the hose adapter 308. To keep the inwardly curved end 333 of the center section of the adapter that is free to rotate 306 and the circumferential end cap with openings 323 in contact, a leaf spring 328 is utilized. As illustrated on FIG. 9, a center section of the leaf spring 328 contacts the solid center 324 of the circumferential end cap with openings 323. As further illustrated on FIG. 9, ends of the leaf spring 328 bear against a circumferential lip 330 on an inside central surface of the center section of the adapter that is free to rotate 306. To prevent water leakage when the faucet adapter 300 is in use, a circumferential gasket 332 is installed between the inwardly curved end 333 of the center section of the adapter that is free to rotate 306 and the circumferential end cap with openings 323. The plurality of circumferential openings 326 in the circumferential end cap with openings 323 allow water to flow through the circumferential end cap with openings 323 when water is flowing through the faucet attachment adapter 300 when in use. The hose adapter 308 allows different size hoses to be connected to the faucet attachment adapter 300. FIG. 9 illustrates the hose adapter 308 configured as a serrated cone 339. The serrated cone 339 allows different size hoses to be attached to the hose adapter 308. In order to prevent unwanted rotation of the seal housing 304 to the center section 306 when the seal 302 is in the sealing orientation (FIG. 11), the locking mechanism 182 of FIG. 4 may be utilized in the embodiment of FIG. 9.

Figure 10:
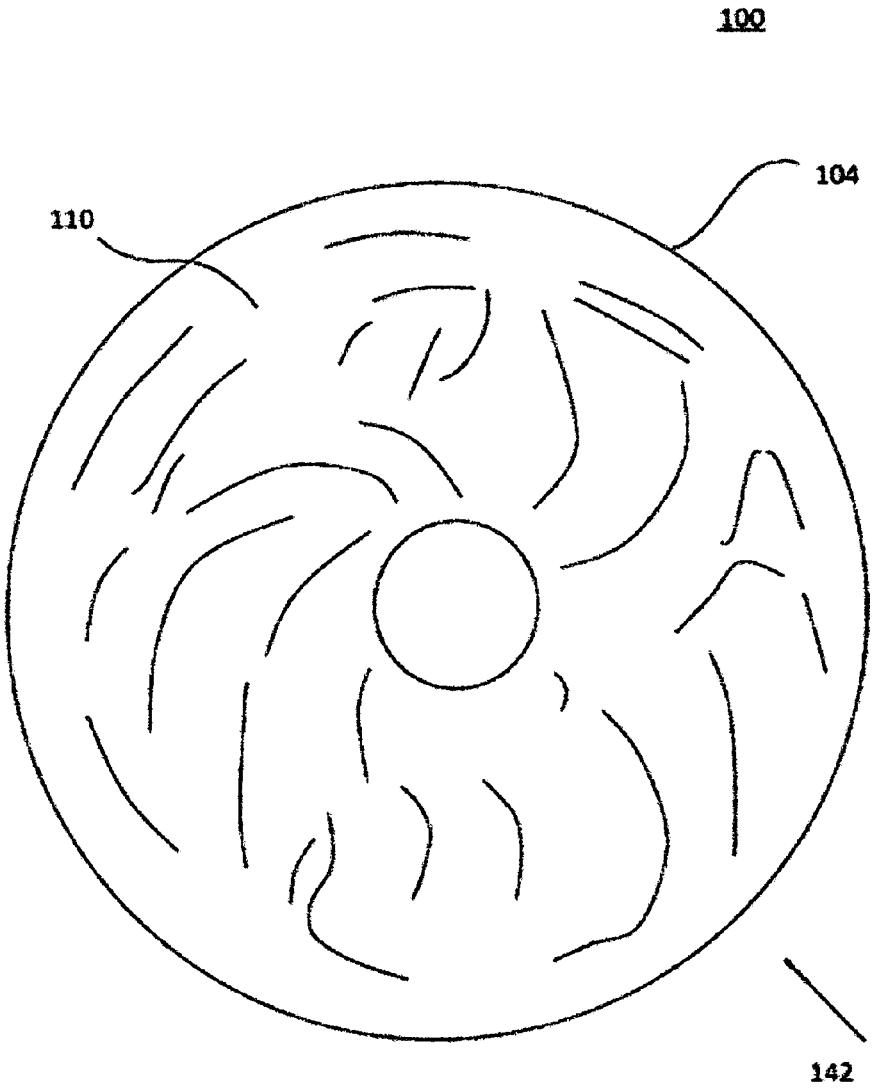
FIG. 10 is an elevation view of the faucet attachment adapter from an end of the faucet attachment adapter with the seal in an open configuration, according to an implementation.
Figure 11:
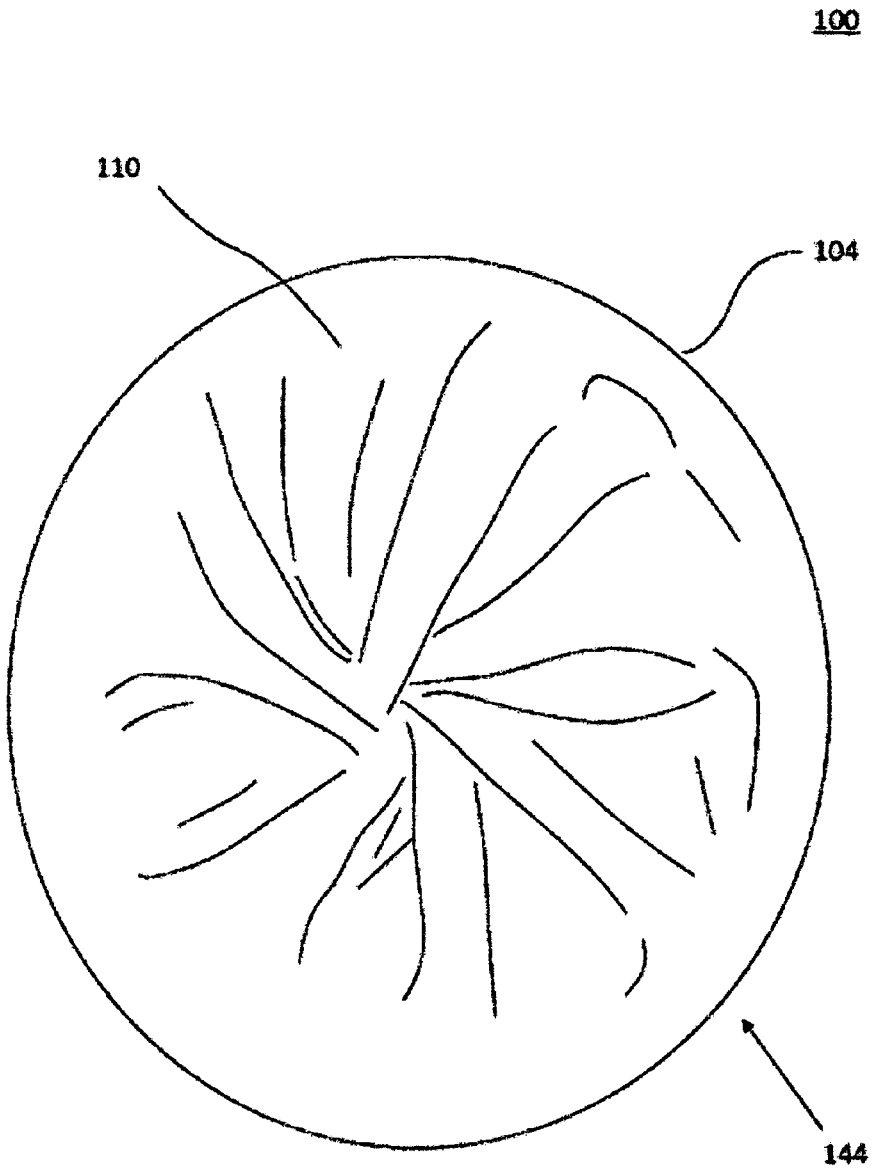
FIG. 11 is an elevation view of the faucet attachment adapter from an end of the faucet attachment adapter with the seal in a closed configuration, according to an implementation.

FIG. 10 is an elevation view of the faucet attachment adapter 100, 200, 300 from an end of the faucet attachment adapter 100, 200, 300 with the iris seal 110, 210, 310 in an open orientation 142, 242, 342 according to an implementation.

FIG. 11 is an elevation view of the faucet attachment adapter 100, 200, 300 from an end of the faucet attachment adapter 100, 200, 300 with the iris seal 110, 210, 310 in a sealing orientation 144, 244, 344 according to an implementation. The iris seal 110, 210, 310 is oriented from the open orientation 142, 242, 342 to the sealing orientation 144, 244, 344 by rotating the adapter housing 106, 206, 306 or the center section of the adapter that is free to rotate 106, 206, 306 relative to the seal housing 104, 204, 304. The second end 113, 213, 313 of the iris seal 110, 210, 310 is attached to the adapter housing 106, 206, 306 as illustrated on FIGS. 2 and 3 and the center section of the adapter that is free to rotate 106, 206, 306 as illustrated on FIGS. 1-9. The first end 112, 212, 312 of the iris seal 110, 210, 310 is attached to the seal housing 104, 204, 304. Rotation of the adapter housing 106, 106, 306 of the faucet attachment adapter 110, 210, 310 relative to the seal housing 104, 20, 304 causes a part of the iris seal 110, 210, 310 proximal the second end 113, 213, 313 of the iris seal 110, 210, 310 to twist into the sealing orientation 144, 244, 344 as illustrated on FIG. 11.

Figure 12:
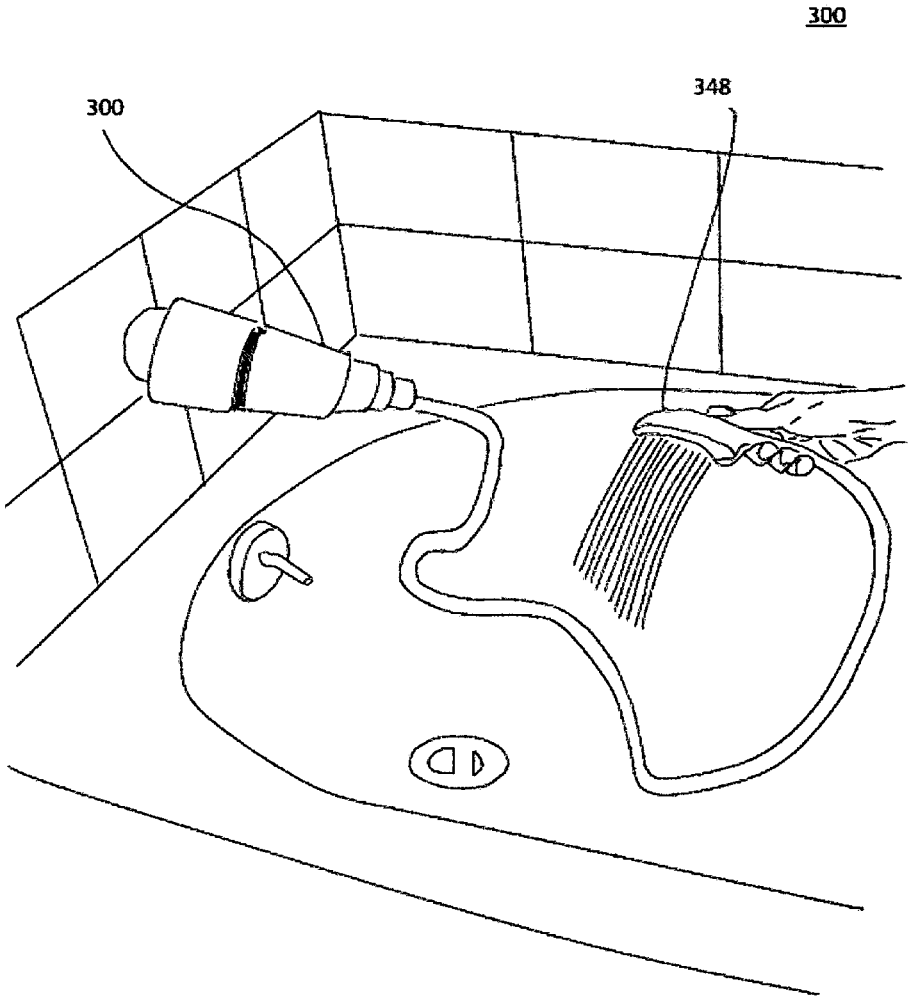
FIG. 12 is a perspective view of the faucet attachment adapter illustrating the faucet attachment adapter attached at one end to a bathtub faucet and attached to a hose and sprayer assembly at the other end of the faucet attachment adapter, according to an implementation.

FIG. 12 is a perspective view of the faucet attachment adapter 300 illustrating the faucet attachment adapter 300 attached at one end to a bathtub faucet and attached to a hose and sprayer assembly 348 at the other end of the faucet attachment adapter 400, according to an implementation. As illustrated on FIG. 12, with the seal assembly 400 attached at one end to a bathtub faucet the other end of the seal assembly attached to the hose and sprayer assembly 448, the faucet attachment adapter allows use of the hose and sprayer assembly 448 to clean a bathtub shower stall. Although FIG. 12 illustrates the faucet attachment adapter attached to a bathtub faucet, the faucet attachment adapter 400 is not limited to a bathtub faucet and may be attached to any type of faucet.

Figure 13:
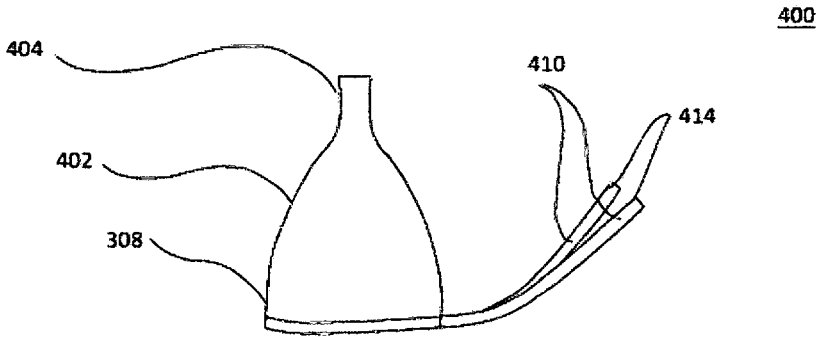
FIG. 13 is an elevation view of another implementation of the faucet attachment adapter from a front of the faucet attachment adapter, according to another implementation.
Figure 14:
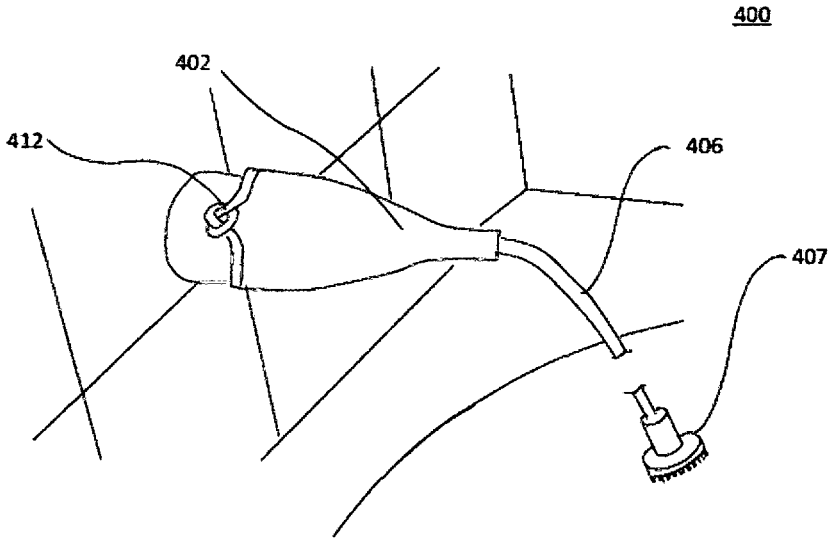
FIG. 14 is a perspective view of the faucet attachment adapter illustrating the faucet attachment adapter attached at one end to a bathtub faucet and attached to a hose and scrubber assembly at the other end of the faucet attachment adapter, according to another implementation.

FIG. 13 is an elevation view of another implementation of a faucet attachment adapter 400 from a front of the faucet attachment adapter 400. As illustrated on FIG. 13, the faucet attachment adapter 400 body 402 is formed of a flexible bladder material. One end of the faucet attachment adapter 400 body 402 is narrow 404. This narrow end 404 of the faucet attachment adapter 400 body 402 is attachable to a hose 406 (FIG. 14). Another end of the faucet attachment adapter 400 body 402 is wide 408. This wide end 408 of the faucet attachment adapter 400 body 402 is attachable to a faucet or a bathtub spigot (FIG. 14). The wide end 408 of the faucet attachment adapter 400 body 402 is formed as two strips 410. The two strips 410 on the wide end 408 of the faucet attachment adapter 400 body 402 facilitate attachment of the faucet attachment adapter 400 to a faucet or bathtub spigot as illustrated on FIG. 14.

FIG. 14 is a perspective view of the faucet attachment adapter 400 illustrating the faucet attachment adapter 400 attached at one end to a bathtub faucet and attached to a hose 406 at the other end of the faucet attachment adapter 400. As illustrated on FIG. 14, the narrow end 404 of the faucet attachment adapter 400 body 402 is attachable to the hose 406 by expanding and slipping the body over the hose 406. In an implementation, a sprayer or scrubber 407 attachment is attachable to the hose 406 to facilitate cleaning. The scrubber attachment 407 is caused to spin by water flowing through the attachment to facilitate scrubbing of surfaces. As illustrated on FIG. 14 the wide end 408 of the faucet attachment adapter 400 body 402 is attachable to the a bathtub faucet by expanding and slipping, as required the wide end 408 of the faucet attachment adapter 400 body 402 over the bathtub faucet. Although FIG. 14 illustrates the faucet attachment adapter 340 attachable to a bathtub faucet, the faucet attachment adapter 400 is attachable to other faucets, such as a sink faucet, faucet attachment adapter 400 is further secured to the bathtub faucet illustrated in FIG. 14 by tying the two strips 410 on the wide end 408 of the faucet attachment adapter 400 body 402 in a knot 412 according to an implementation. In another implementation, the strips 410 have hook-and-loop fasteners 414 on one side of the strips 410 to allow the strips 410 to be fastened to each other in lieu of being tied in a knot.

Figure 15:
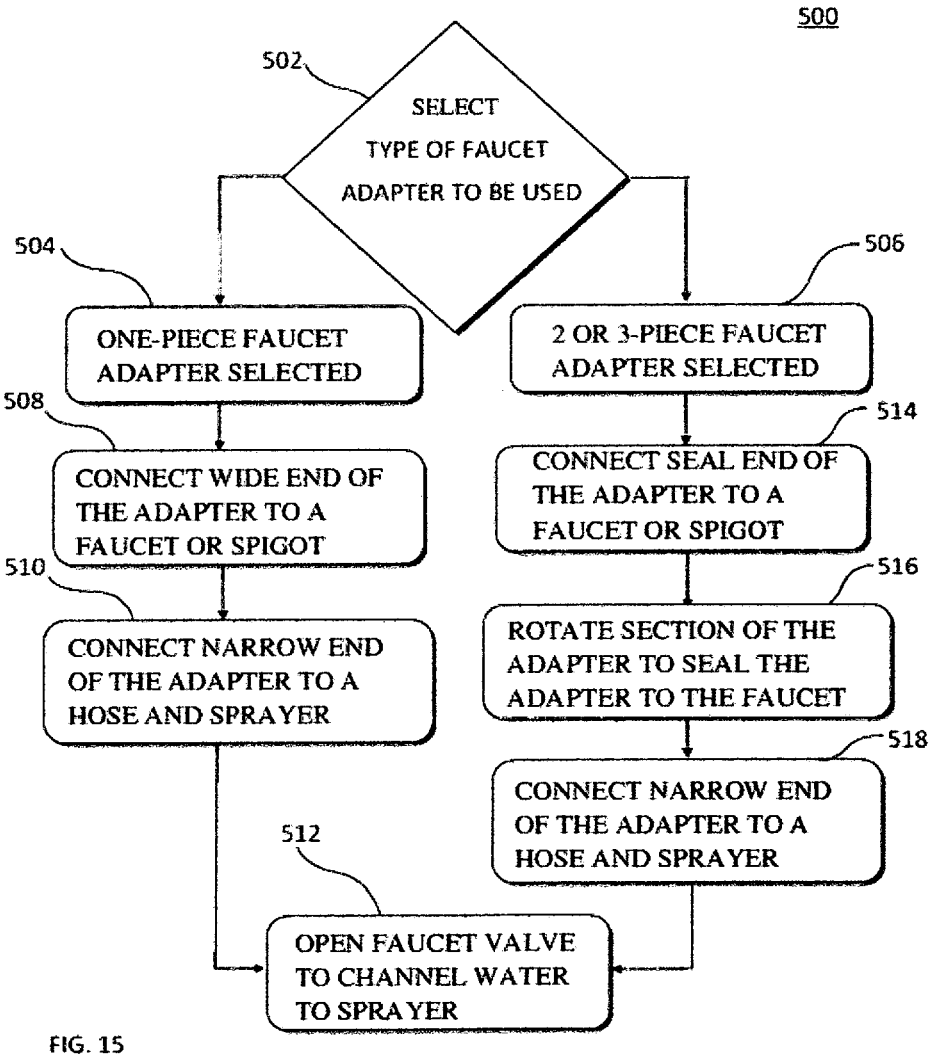
FIG. 15 is a flowchart of a method of using the faucet attachment adapter, according to an implementation.

FIG. 15 is a flowchart of a method 500 of using the faucet attachment apparatus, according to an implementation. Method 500 includes selecting the type of faucet attachment adapter 100, 200, 300, 400 to be utilized at block 502, namely a one-piece faucet attachment adapter at block 504 or a two or three-piece faucet attachment adapter at block 506. If a one-piece faucet attachment adapter 400 is selected 504, the wide end 408 of the faucet attachment adapter 400 is connected to a faucet or spigot at block 508. After the wide end 408 of the one-piece faucet attachment adapter 400 is connected to a faucet or spigot the narrow end 404 of the one-piece faucet attachment adapter 400 is connected to a hose and sprayer assembly at block 510. The faucet valve is then opened to channel water through the faucet attachment adapter 400 to the sprayer at block 512. If a two or three-piece faucet attachment adapter 100, 200, 300 is selected 506, the seal end of the faucet attachment adapter 100, 200, 300 is placed over a faucet or spigot at block 514. After the seal end of the faucet attachment adapter 100, 200, 300 is placed over a faucet or spigot, a section of the adapter that is free to rotate 106, 206, 306 of the two or three-piece faucet attachment adapter 100, 200, 300 section of the adapter that is free to rotate 106, 206, 306 is rotated to place the iris seal 110, 210, 310 in a sealing orientation 144, 244, 344 at block 516 so that the faucet attachment adapter 100, 200, 300 is sealed to the faucet or spigot. After the faucet attachment adapter 100, 200, 300 section of the adapter that is free to rotate 106, 206, 306 is rotated to place the iris seal 110, 210, 310 is a sealing orientation 144, 244, 344 the hose adapter 108, 208, 308 of the two or three-piece faucet attachment adapter 100, 200, 300 is connected to a hose and sprayer assembly 348 at block 518. The faucet valve is then opened to channel water through the faucet attachment adapter 100, 200, 300 to the sprayer at block 512.

As a person skilled in the prior art will recognize after examination of the previous detailed description and the figures and claims, modifications and changes may be made to the preferred embodiments of the invention without departing from the scope of the invention as defined in the following claims.

The invention claimed is:

1. A faucet attachment adapter comprising:

a seal wherein the seal has a first end and a second end;

a seal housing;

an adapter housing wherein the adapter housing is rotatably mounted to the seal housing wherein the adapter housing is rotatable relative to the seal housing; wherein the first end of the seal is mounted to the seal housing, and the second end of the seal is mounted to the adapter housing such that rotating the adapter housing rotates the second end of the seal relative to the first end of the seal, thereby causing the seal to move between the an open position which enables the faucet attachment adapter to be placed over a faucet and a sealing position operative to seal the faucet attachment adapter around the faucet; and a house adapter.

2. The faucet attachment adapter of claim 1 wherein the first end of the seal is mounted to an interior of the seal housing.

3. The faucet attachment adapter of claim 2 wherein the first end of the seal is mounted to the interior of the seal housing by a snap ring.

4. The faucet attachment of claim 1 wherein the second end of the seal is mounted to an interior of the adapter housing by a snap ring.

5. The faucet attachment adapter of claim 1 wherein the seal housing and the adapter housing are threadably connected.

6. The faucet attachment adapter of claim 1 wherein the hose adapter is configured as steps in order to allow different size hoses to be attached to the hose adapter.

7. The faucet attachment adapter of claim 1 wherein the hose adapter is configured as a serrated cone in order to allow a plurality of different size hoses to be attached to the hose adapter.

8. The faucet attachment adapter of claim 1 wherein the hose adapter is configured as a spigot.

9. The faucet attachment adapter of claim 1 wherein a forward face of the adapter housing is formed as a cam and an aft face of the seal housing is formed as a follower.

10. The faucet attachment adapter of claim 9 wherein a profile of the cam and follower is sloped.

11. The faucet attachment adapter of claim 9 wherein a profile of the cam and follower has a step.

12. The faucet attachment adapter of claim 1 wherein the faucet attachment adapter includes a locking mechanism.

13. The faucet attachment adapter of claim 12 wherein the locking mechanism includes a seal side and an adapter side, each of the seal side and the adapter side including a tooth.

14. The faucet attachment adapter of claim 13, wherein the tooth on the seal side and the tooth on the adapter side are capable of moving between an engaged position and a disengaged position.

15. The faucet attachment adapter of claim 12 wherein the adapter housing has a select fit inside the seal housing, wherein the locking mechanism includes a pin and a channel, the pin being located on an outer circumferential surface of the adapter housing, the channel being located on an inner circumferential surface of the seal housing, wherein the channel includes a rise channel portion and a locking portion.

16. The faucet attachment adapter of claim 1, wherein rotating the adapter housing relative to the seal housing additionally causes the adapter housing to separate axially from the seal housing.

17. A method of using a faucet attachment adapter comprising:

procuring a faucet attachment adapter comprising a seal; wherein the seal has a first end and a second end;

the faucet attachment adapter further comprising a seal housing and an adapter housing, wherein the adapter housing is adapted to the seal housing, wherein the adapter rotates relative to the seal housing; wherein the first end of the seal is mounted to the seal housing, and the second end of the seal is mounted to the adapter housing;

the faucet attachment adapter additionally comprising a hose adapter;

wherein the seal is oriented in an open orientation; and rotating the adapter housing such that the second end of the seal rotates relative to the first end of the seal is oriented in a sealing orientation.

* * * * *